US005328511A

United States Patent [19]

Beisswanger

[11] Patent Number: 5,328,511

[45] Date of Patent: Jul. 12, 1994

[54] COATING DEVICE HAVING TWO SEPARATE COLLECTION TROUGHS CONNECTED TO EACH OTHER

[75] Inventor: Rudolf Beisswanger, Steinheim, Fed. Rep. of Germany

[73] Assignee: J. M. Voith GmbH, Fed. Rep. of Germany

[21] Appl. No.: 948,401

[22] Filed: Sep. 21, 1992

[30] Foreign Application Priority Data

Sep. 19, 1991 [DE] Fed. Rep. of Germany ..... 4131131

[51] Int. Cl.[5] ..... B05C 1/08

[52] U.S. Cl. ..... 118/203; 118/227; 118/244; 118/262; 15/256.51

[58] Field of Search ..... 118/203, 227, 244, 262; 101/350, 351, 425; 15/256.51; 162/281

[56] References Cited

U.S. PATENT DOCUMENTS

| | | | |
|---|---|---|---|
| 2,729,192 | 1/1956 | Warner . | |
| 2,946,307 | 12/1955 | Warner . | |
| 3,084,663 | 8/1960 | Warner . | |
| 4,300,476 | 11/1981 | Jurascheck et al. | 118/203 |
| 4,367,120 | 1/1983 | Hendrikz | 15/256.51 |
| 4,848,268 | 7/1989 | Sollinger et al. . | |
| 4,872,416 | 10/1989 | Daniel et al. | 118/203 |
| 4,906,335 | 3/1990 | Goodnow et al. | 162/281 |
| 5,021,124 | 6/1991 | Turtinen et al. | 162/281 |
| 5,046,416 | 9/1991 | Freyer et al. | 101/425 |

FOREIGN PATENT DOCUMENTS 3512892 4/1985 Fed. Rep. of Germany .

*Primary Examiner*—W. Gary Jones
*Assistant Examiner*—Todd J. Burns
*Attorney, Agent, or Firm*—Ostrolenk, Faber, Gerb & Soffen

[57] ABSTRACT

A device for applying coating composition to a fiber web has at least one application roll for receiving a film of coating color at a feed location and for then delivering it to the fiber web at a delivery location. A nozzle applicator feeds coating color to a nozzle at the feed position of application roll. The nozzle has a downstream lip with a metering doctor on it for metering the thickness of the coating color applied to the roll. The nozzle has an upstream lip in the form of an overflow ledge spaced from the surface of the application roll. Coating liquid overflows the overflow ledge and is collected in a first overflow trough. To clean the outer surface of the application roll before coating color is thereto applied, a scraper blade scrapes the surface of the roll. Upstream in the rotation path from the scraper blade is a sprayer for spraying liquid on the application roll so that the scraper scrapes the surface of the application roll with liquid on it. A separate liquid collection trough is connected to the first overflow trough and positioned to receive liquid scraped from the surface of the application roll by the scraper blade. The scraper blade is adjustable to adjust the width of a slot between the scraper blade and the surface of the roll. The scraper blade forms a part of a guide wall for leading liquid which has been scraped off into the liquid collection trough.

18 Claims, 2 Drawing Sheets

COATING DEVICE HAVING TWO SEPARATE COLLECTION TROUGHS CONNECTED TO EACH OTHER

BACKGROUND OF THE INVENTION

The present invention relates to a device for applying coating color to a fiber web. The device includes an application roll for applying the coating to the web, a nozzle which delivers the coating to the application roll, a trough to receive overflow coating and a device for cleaning the application roll surface including liquid application means and a scraper following the liquid application as the roll rotates.

Devices of this type can be arranged as part of or inside of or else outside of a paper manufacturing machine. The liquid to be applied may, for instance, be a size suspension with which the web of paper is to be impregnated, i.e. the size suspension penetrates more or less completely into the interior of the paper web. However, the liquid may alternatively be a coating composition meaning pigment suspensions of different types, from which a surface layer is formed on the web of paper. In both cases, the liquid can be applied merely to one side of the paper web or to both sides thereof.

Applicable prior art publications include:

1. Federal Republic of Germany Utility Model 8 414 413 and U.S. Pat. No. 4,848,268
2. U.S. Pat. No. 2,729,192
3. U.S. Pat. No. 2,946,307
4. U.S. Pat. No. 3,084,663
5. "Wochenschrift für Papierfabrikation" 1973, pages 164 to 169.
6. "Wochenschrift für Papierfabrikation" 1978, pages 773 to 778.
7. German Published Application DE-OS 35 12 892.

The invention proceeds from Reference 1, and particularly from FIG. 2 thereof. That discloses two application rolls which together form a nip through which a web of paper passes. Each of the two application rolls has a nozzle applicator associated with it which applies a film of coating color to the outer surface of the respective roll. Each nozzle applicator has a nozzle with two nozzle lips. The lip which is downstream in the direction of roll rotation has a free end which supports a roll doctor, i.e. a bar having a grooved outer surface. This enables a metered application of coating color to the outer surface of the roll.

Although it is not shown in Reference 1, in practice, a cleaning device is always present in order to clean the outer surface of each application roll. This cleaning device is located between the place where the film of coating color is transferred from the outer surface of the roll to the web of paper, i.e. the delivery position, and the place where the nozzle applicator delivers the film of coating color onto the outer surface of the roll, i.e. the feed position. Such cleaning devices are necessary for various reasons. On the one hand, particles of coating color and, on the other hand, fibers which are torn out of the web of paper upon its removal from the outer surface of the roll remain on the outer surface. These are stubborn deposits which accumulate upon each revolution of the roll and the deposits lead to non-uniformities in the film of coating color as well as to disturbances. Therefore, the deposits must be eliminated.

The known cleaning device comprises a scraper having a scraper blade which, in operation, is applied against the outer surface of the roll, and further comprises a source of liquid that applied liquid to the roll surface before or upstream in the path of roll rotation of the scraper blade contact with the roll surface. The source of liquid has two purposes. On the one hand, it sprays cleaning liquid onto the outer surface of the roll for loosening the deposits, or at least it prepares for the loosening thereof. On the other hand, it assures that at all times neither the scraper blade nor the subsequent doctor of the applicator nozzle travels dry over the roll surface. The blade and the doctor must be lubricated at all times. If this is not done, then the sensitive outer surface of the roll may be damaged by the scraper blade or the metering doctor.

Even before commencement of the coating operation, i.e. before the charging of the nozzle chamber with coating color, and thus before application of a coating film onto the outer surface of the roll, the liquid source must supply sufficient liquid in order to lubricate both the scraper blade and the doctor. The liquid source is generally a spray pipe which extends over the outer surface of the roll. The liquid is thus applied to the outer surface in excess quantity before commencement of the coating operation and the liquid remains adhering to the roll outer surface, passing through the slot between the scraper blade and the outer surface. A part of this adherent liquid then always continues to travel with the outer surface and arrives at the doctor, so as to also lubricate it. Another part of the liquid passes into the coating color collection trough. That trough is arranged in front of or upstream of the nozzle applicator in order to receive excess coating color. The trough therefore contains a mixture of coating color and cleaning liquid.

Once the coating operation has been started, and when the nozzle delivers a film of coating color in the desired amount to the outer surface of the roll, the metering doctor is lubricated by the coating color, and the doctor then does not require a separate lubricating liquid. It is then merely necessary to assure that the scraper blade receives sufficient lubricating liquid, generally water. The source of liquid thus need deliver less liquid after this time. Throttling of the amount of liquid being applied is, however, also necessary, since otherwise there is an undesired dilution and thus an impairment of the film of coating color.

The problem to which the invention is addressed starts here. It is difficult to adapt the following parameters to one another, namely the time of the commencement of the coating operation, i.e. the feeding of the film of coating color onto the outer surface of the roll, the time of the throttling of the feed of liquid, and the extent of the throttling.

SUMMARY OF THE INVENTION

The object of the present invention is to develop a device coating applicator of the above type so that neither the scraper blade nor the metering doctor runs dry at any time, and so that a suitable film of coating color of desired thickness and nature is fed onto the applicator roll and finally transferred to the fiber web.

This object is achieved by features of the invention.

The free end edge of the scraper blade is adjustable. This assures control over what is taking place in the region of the scraper blade. A suitable actuating device adjusts the width of the slot between the scraper blade and the outer surface of the roll. In this way, the amount of liquid which is passed by the outer surface of the roll through the slot can be precisely defined.

A liquid collection trough, which is separated from the collection trough for excess or removed coating color, is disposed to receive liquid from in front of or upstream in the roll rotation direction of the scraper. The scraper blade forms a part of the guide wall which leads liquid that has been scraped off the roll surface into the liquid collection trough. This assures that the path of the liquid is controlled. All features contribute to avoiding two elements running dry, namely the scraper blade and the metering doctor, and to avoiding undesired dilution of the collected excess coating color in the coating color trough. The coating color trough still receives excess coating color. The special trough receives the cleaning liquid separately. The liquid present in the coating color through can thus be recycled unchanged, or at least undiluted by scraped off liquid, to the nozzle chamber for reuse.

Other features and advantages of the present invention will become apparent from the following description of the invention which refers to the accompanying drawings.

DETAILED DESCRIPTION OF THE INVENTION

Figure 1:
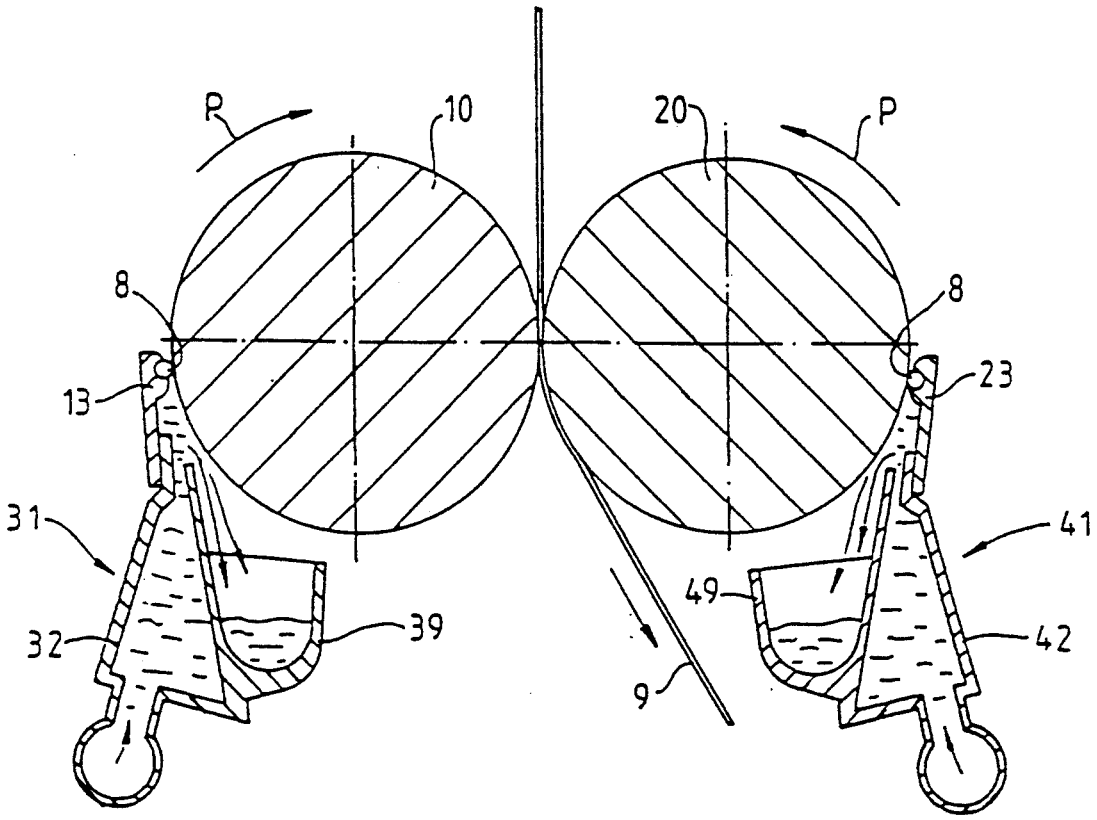
Fig.1 PRIOR ART
FIG. 1 shows a device in accordance with the prior art, particularly Federal Republic of Germany Utility Model 8 414 413.

The known application device shown in FIG. 1 has two parallel, fixedly supported, rotatable application rolls 10, 20, a respective nozzle applicator 31, 41, for each of the rolls 10, 20, a respective nozzle chamber 32, 42 of each applicator, a respective machine wide nozzle lip 13, 23 on each chamber, a metering doctor 8 on each lip, and a respective excess coating color collection trough 39, 49 for each roll. The two application rolls 10, 20 rotate respectively in the directions of the arrows P. A web of paper 9 is passed through the nip which is formed between the two co-rotating rolls.

In operation, the two nozzle chambers 32, 42 receive a stream of coating color from pumps (not shown). A part of this stream passes up to the nozzle and thus to its outlet at the top of the nozzle chamber, where the coating color is metered by the corresponding metering doctor 8 and is deposited as a film onto the outer surface of the respective rolls 10, 20. A smaller part of the coating color passes over the top of the other trailing or upstream nozzle lip as a surplus stream and enters the corresponding color collection trough 39, 49. The film of the coating color is fed to the moving paper web 9 in the region of the nip between the two rolls so that the paper web is provided with a coating applied on both side surfaces.

Figure 2:
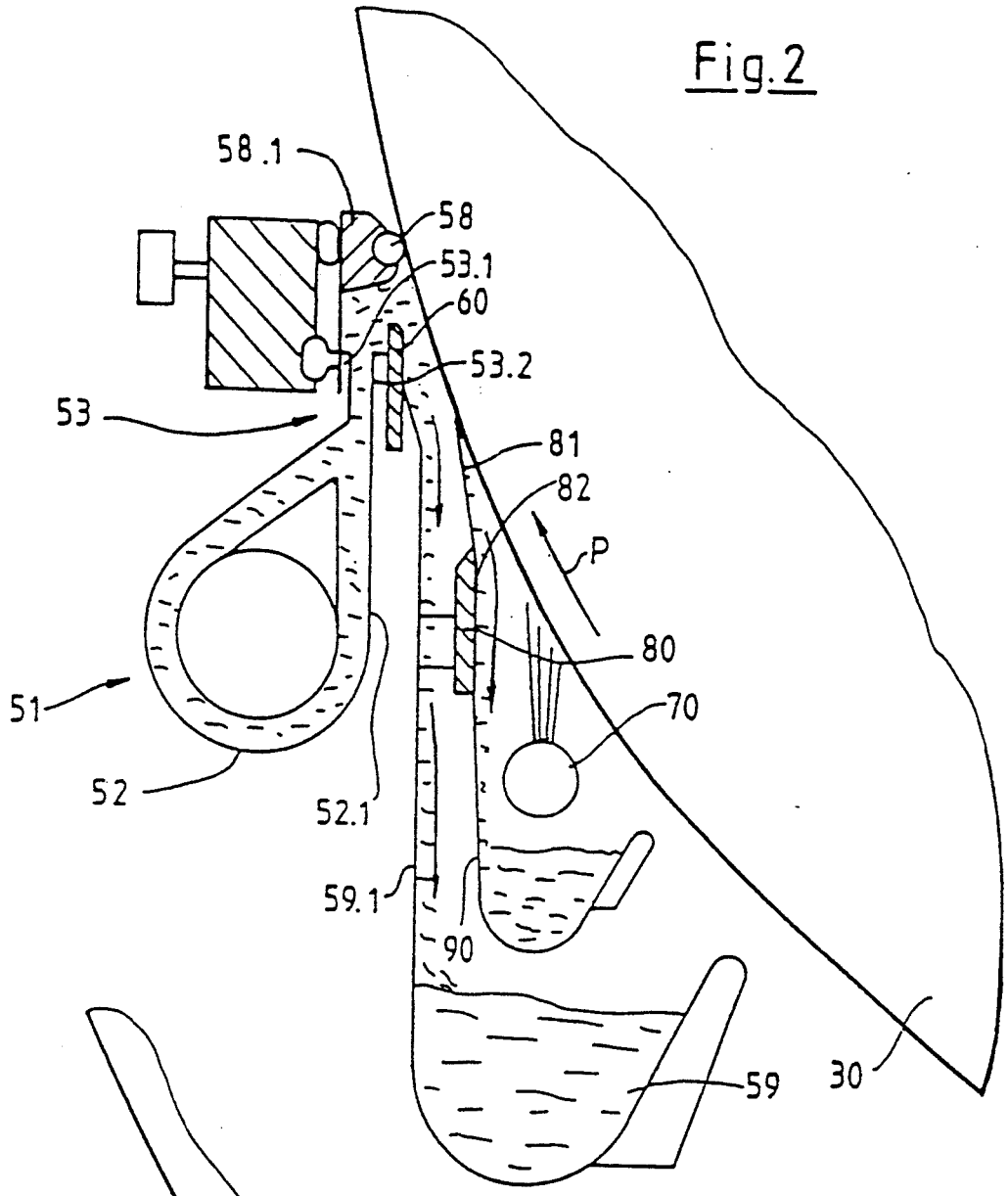
FIG. 2 shows the essential parts of an application device of the invention, in particular the application roll, the nozzle applicator, and the cleaning device.

FIG. 2 like FIG. 1, is in a section perpendicular to the axis of the application roll 30. The roll 30 in FIG. 2 is shown on a substantially larger scale than the rolls 10, 20 in FIG. 1.

The roll 30 has an associated nozzle applicator 51. The application comprises a nozzle chamber 52, illustrated as generally annular in cross section, and a nozzle 53 at the top of the chamber. The nozzle 53 is defined by two spaced apart, parallel nozzle lips 53.1 and 53.2, which also extend parallel to the axis of the application roll 30. The leading or downstream lip 53.1 bears a so called roll doctor 58. The doctor is mounted in a roll doctor bed 58.1. The trailing or upstream nozzle lip 53.2 bears an overflow ledge 60 which defines the upstream side of the nozzle. The free edge of the ledge 60 is spaced away from the roll surface, defining an overflow slot.

An overflow trough 59 receives the excess stream of coating color which has passed over the overflow ledge 60.

The nozzle applicator 51 has a cleaning device arranged in front of it or upstream around the roll from the feed position where coating color liquid is applied to the roll. The cleaning device comprises a spray pipe 70, which sprays liquid on the surface of the roll, a scraper 80 with a scraper blade 81 having a free edge which cooperates with the roll surface downstream of the liquid spray thereon and a collection trough 90 to receive cleaning liquid which is removed from the roll surface by the scraper. A guide wall 82 guides the liquid scraped off of roller 30 to collection trough 90.

Figure 3:
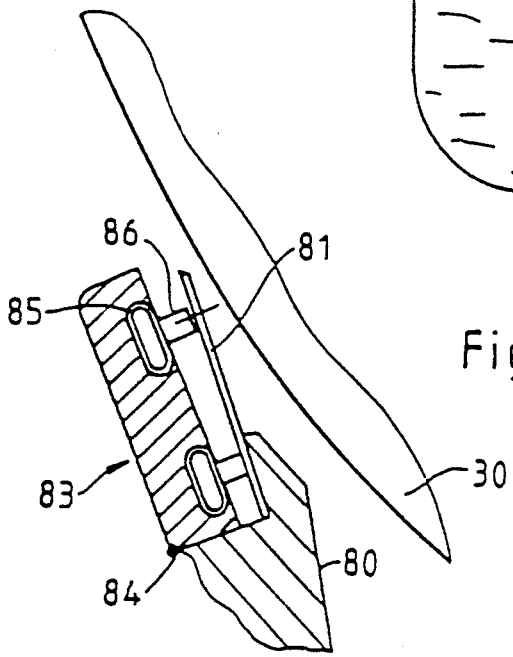
FIG. 3 shows a detail of FIG. 2.

The detail view in FIG. 3 shows, on a still larger scale, the roll 30 on which the film of coating color is to be applied, the scraper 80 of the cleaning device, the scraper blade 81, and a blade pressing device 83. The pressing device 83 is swingable around an axis of swing 84. An inflatable hose 85 extends along the width of the device 83. On the hose there is formed a ledge 86 which extends over the entire width of the machine and projects into engagement with the blade 81. Pressing of the scraper blade 81 toward the surface of the roll 30 can be effected by two processes. On the one hand, the entire pressing device 83 can be swung in the direction indicated by the arrow extending along the width of the device 83 around the pivot axis 84 while, on the other hand, the hose 85 can be inflated.

A suitable control assures that the pressing of the blade 81 toward the surface of the roll 30 can only occur when the spray pipe 70 is operating and therefore when liquid, for instance water, is being sprayed from the pipe against the outer surface of the roll 30. This protects the roll surface from being scraped while dry.

As can be noted from FIG. 2, the entire device is integrated practically so as to form a single structural unit. The nozzle applicator 51 is firmly attached via its overflow ledge 60 to the wall 59.1 of the overflow trough 59. The scraper 80 is also firmly attached to the wall 59.1 A structure is conceivable in which the facing walls of the nozzle applicator 51 and the collection trough 59, namely the spaced apart walls 52.1 and 59.1, are combined to form a single wall.

The metering doctor 58 need not necessarily be profiled as in the known design. It may also have a non-profiled outer surface.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for applying a coating composition to the surface of a fiber web passing by the device, the device comprising:

a rotatable application roll having a feed position located on an outer surface of the roll, a film of coating composition being delivered to the outer surface of the roll at the feed position, the roll having a delivery position located on the outer surface of the roll downstream from the feed position in a rotation direction of the roll, the application roll delivering the coating composition to the fiber web at the delivery position;

a nozzle applicator for delivering the film of coating composition to the application roll surface at the feed position, the applicator comprising:

a nozzle chamber for receiving coating composition, an outlet nozzle extending from the chamber and located at the feed position for delivering the coating composition to the surface of the application roll at the feed position, the nozzle being defined by two spaced apart lips;

one of the nozzle lips being a leading lip located downstream from the feed position in the direction of roll rotation, the leading lip having a first free end which supports a metering doctor that cooperates with the surface of the application roll to form an outlet slot for creating a metered film of coating composition on the application roll;

the other nozzle lip being a trailing lip located upstream from the feed position in the direction of roll rotation, the trailing lip having a second free end that is spaced away from the surface of the application roll and forms an overflow slot between the second free end of the trailing lip and the application roll for receiving an excess stream of the coating composition passing from the nozzle chamber through the nozzle;

an overflow trough placed at an outlet side of the overflow slot to receive the excess stream of coating composition from the overflow slot;

a cleaning device for cleaning the outer surface of the roll, the cleaning device located upstream from the feed position in the rotation direction of the application roll and between the delivery position and the feed position, the cleaning device comprising;

a scraper comprising a scraper blade having a blade edge for cooperating with the roll surface at a location upstream from the nozzle in the rotation direction of the application roll;

a liquid source for applying liquid to the surface of the roll at a location upstream from the scraper in the rotation direction of the application roll; and a liquid collection trough arranged along the surface of the application roll at a location upstream from the scraper blade in the rotation direction of the application roll, the scraper blade being arranged relative to the liquid collection trough to direct liquid scraped by the scraper from the application roll into the liquid collection trough, wherein the liquid collection trough is connected directly to the overflow trough.

2. The device of claim 1, wherein the liquid source comprises a sprayer for applying liquid by spraying the liquid on the surface of the roll at a point located upstream from the scraper blade in the rotation direction of the application roll.

3. The device of claim 2, wherein the sprayer is aimed to spray liquid to the application roll above the liquid collection trough so that liquid from the sprayer is collected in the liquid collection trough.

4. The device of claim 2, further comprising a pressing device for adjustably moving the scraper blade for setting the scraper blade against the outer surface of the application roll and means for adjusting the scraper blade for defining and adjusting a slot width between the scraper blade edge and the roll surface.

5. The device of claim 1, further comprising a guide wall connected to the liquid collection trough for leading liquid which the scraper blade has scraped off the application roll into the liquid collection trough.

6. The device of claim 5, wherein the scraper blade forms a part of the guide wall for leading liquid into the liquid collection trough.

7. The device of claim 5, wherein the nozzle applicator comprises a first rear wall and a first front wall, the first rear wall being located closer to the roll than the first front wall, the coating composition overflow trough comprising at least a second rear wall and a second front wall, the second front wall being located farther away from the application roll than the second rear wall;

the first rear wall of the nozzle applicator and the second front wall of the overflow trough being joined together to form a single wall, and the single wall supports the trailing lip of the nozzle.

8. The device of claim 1, wherein the overflow trough comprises a guide wall for guiding the excess stream of coating composition from the overflow slot to the overflow trough and the liquid collection trough is connected to the overflow trough guide wall such that the overflow trough and the liquid collection trough are separate troughs which together form a single structural unit.

9. The device of claim 8, wherein the liquid collection trough comprises a guide wall for guiding the liquid scraped off of the roll by the scraper blade, the overflow trough guide wall being connected to the liquid collection trough guide wall.

10. The device of claim 9, wherein the scraper blade forms a part of the liquid collection trough guide wall and the overflow trough guide wall is connected to the scraper blade.

11. The device of claim 1, further comprising a pressing device for adjustably pressing on the scraper blade for setting the scraper blade against the outer surface of the application roll.

12. The device of claim 11, wherein the pressing device is controllable to set the scraper blade against the outer surface of the application roll when the liquid source is applying liquid to the application roll.

13. The device of claim 11, wherein the scraper blade comprises a free edge and the pressing device is operable for pressing the free edge of the scraper blade against the application roll and for moving the free edge of the scraper blade away from the surface of the application roll.

14. The device of claim 1, further comprising an additional application roll rotatable together with the application roll for defining a nip between the application roll and the additional application roll, wherein the web is directed through the nip.

15. The device of claim 14, wherein the additional application roll has an additional nozzle applicator, an additional overflow trough, an additional liquid collection trough and an additional cleaning device located upstream from the nip in the rotation direction of the application roll.

16. The device of claim 15, wherein the additional liquid collection trough is connected to the additional overflow collection trough.

17. The device of claim 1, wherein the liquid collection trough is located above the overflow trough.

18. The device of claim 1, wherein the overflow collection trough comprises a substantially U-shaped member located relative to the application roll to define a substantially U-shaped region between the overflow trough and the application roll, the liquid collection trough being located within the substantially U-shaped region.

* * * * *